US006093687A

United States Patent [19]

Saito et al.

[11] Patent Number: 6,093,687

[45] **Date of Patent: *Jul. 25, 2000**

[54] DETERGENT COMPOSITION

[75] Inventors: Hiroshi Saito; Chie Takahashi; Masahiro Nishizawa, all of Tokyo; Hiroshi Yamamoto, Yokohama; Kiyobumi Takahashi, Tokyo, all of Japan

[73] Assignee: Nitto Chemical Industries Co., Ltd., Tokyo, Japan

[ * ] Notice: This patent is subject to a terminal disclaimer.

[21] Appl. No.: 09/114,901

[22] Filed: Jul. 14, 1998

Related U.S. Application Data

[63] Continuation of application No. 08/772,988, Dec. 23, 1996, Pat. No. 5,851,970.

[30] Foreign Application Priority Data

Dec. 25, 1995 [JP] Japan ..... 7-350042

[51] Int. Cl.[7] ..... C11D 3/33

[52] U.S. Cl. ..... 510/219; 510/433; 510/434; 510/435; 510/480

[58] Field of Search ..... 510/181, 219, 510/434, 191, 197, 235, 455, 476, 488, 480, 499, 433

[56] References Cited

U.S. PATENT DOCUMENTS

| | | | |
|---|---|---|---|
| 3,637,511 | 1/1972 | Yang | 252/527 |
| 4,521,332 | 6/1985 | Milora | 252/527 |
| 4,935,065 | 6/1990 | Bull | 134/22.13 |
| 5,362,412 | 11/1994 | Hartman et al. | 252/94 |
| 5,543,566 | 8/1996 | Takahashi et al. | 562/571 |
| 5,851,970 | 12/1998 | Saito et al. | 510/181 |

FOREIGN PATENT DOCUMENTS

| | | |
|---|---|---|
| 513 948 | 11/1992 | European Pat. Off. . |
| 513948A2 | 11/1992 | European Pat. Off. . |
| 2702786A1 | 8/1977 | Germany . |
| A-52-104508 | 9/1977 | Japan . |
| 1 389 732 | 4/1975 | United Kingdom . |
| 1389732 | 4/1975 | United Kingdom . |

OTHER PUBLICATIONS

Patent Abstract of Derwent Pub., Ltd., 98–126477, re JP 10008096, Jan. 1998.

*Primary Examiner*—John R. Hardee
*Attorney, Agent, or Firm*—Pillsbury Madison & Sutro

[57] ABSTRACT

A detergent composition comprising an alkaline metal hydroxide, an alkaline metal salt of L-aspartic-N,N-diacetic acid, optionally a scale inhibitor and/or an alkaline metal salt of gluconic acid. This detergent composition is used for removing soils, stains and other contaminants adhering to or deposited on the surfaces of glass, plastics, metals, etc., specifically the hard surfaces of, for example, containers for foodstuffs such as drinks and process foods, container boxes, piping of food production equipment, tanks, sterilizing plates, plate heat exchangers, filling machines and the like, by such means as soaking the parts to be cleaned in a cleaning solution, circulating a cleaning solution in the facilities to be cleaned, or spraying a cleaning solution over the surfaces to be cleaned. This detergent composition has excellent cleaning performance and excellent biodegradability.

9 Claims, No Drawings

DETERGENT COMPOSITION

This is a continuation of application Ser. No. 08/772,988, filed Dec. 23, 1996 now U.S. Pat. No. 5,851,970.

BACKGROUND OF THE INVENTION

1. Field of the Invention

The present invention relates to a detergent composition, particularly one suited for removing soils, stains and other contaminants adhering to or deposited on the surfaces of glass, plastics, metals and other objects. More specifically, the present invention pertains to a detergent composition designed to be used for removing soils, stains and other contaminants adhering to or deposited on the hard surfaces of various sorts of articles such as containers for drinks, processed foods and other foodstuffs, container boxes, piping of food producing equipment, tanks, sterilizing plates, plate heat exchangers, filling machines, etc., by suitable means such as soaking the article in a cleaning solution, circulating a cleaning solution in the facilities to be cleaned, or spraying a cleaning solution to the article surface. The detergent composition of the present invention is particularly characterized by its excellent cleaning performance and excellent biodegradability.

2. Description of the Related Art

The production of foodstuffs such as drinks, processed foods, etc., goes on increasing every year and their type is also diversified, entailing greater strictness of hygienic quality control. For instance, diversification of the type of a product increases the opportunity to change the type of the product on the production line, necessitating frequent cleaning of the production equipment.

Cleaning of the production equipment has generally been performed by disassembling the equipment, immersing the dismounted parts in a cleaning fluid and scrubbing off dirt, grime, smears or other contaminants with brushes or other means.

However, enlargement of production equipment and increase of cleaning frequency in recent years has made it inexpedient to rely on such scrub cleaning which necessitates disassemblage of production equipment, and such conventional cleaning method is now being super-ceded by more efficient systems such as a circulation cleaning system in which a cleaning fluid is circulated in the production equipment to be cleaned, and a stationary cleaning system (clean-in-place method) in which a cleaning fluid is sprayed over the surface of wide area, such as the inside surface of a tank, to thereby remove contaminants on the surface.

Diversification of the type of foodstuffs has also compelled use of various kinds of material beside conventional glass, such as plastic, metal, etc., for the containers of foodstuffs, and such diversification of container material has posed the problem that contaminants may not be removed sufficiently by use of the conventional detergents. Also, with reference to glass containers whose use is reconsidered in relation to the movement for recycling of resources, there is observed increasing diversification in type of contaminants deposited on such glass containers. Thus, a detergent with such high detergency as being capable of removing not only conventional types of contaminants but also new types of contaminants originating in metals, adhesives, etc., eluted from the labels and other chemical matters is required.

As detergent for circulation or stationary cleaning of production equipment or for cleaning of containers, the aqueous solutions of detergents containing 1–3 wt % of an alkali metal hydroxide and 0.2–0.4 wt % of an alkali metal salt of ethylene-diaminetetraacetic acid (chelate compound) have been used. There have also been available household detergents comprising a surfactant as main component and containing as minor components an alkali metal salt with relatively low alkalinity, such as alkali metal salt of carbonic acid, silicic acid, phosphoric acid or aspartic-N,N-diacetic acid (EP-A-513,948, U.S. Pat. No. 3,637,511 and GB-A-1, 389,732). Alkali metal salts of aspartic-N,N-diacetic acid used in these detergents are racemates having both D-form and L-form in admixture.

The above-mentioned known detergent solutions containing alkali metal salts of ethylenediaminetetra-acetic acid have high potency in removing contaminants adhering to the surfaces of production equipment, containers, etc., but are low in microbial decomposability. Therefore, the detergent contained in waste water released from food production plants can not be decomposed sufficiently by ordinary activated sludge treatment, causing an increase of COD value of waste water.

Also, the above-mentioned known detergents comprising a surfactant as main component are mostly applied to domestic uses, and in use they generate foams originating in surfactant and are generally low in detergency. When these detergents are used for industrial spray cleaning called "jet cleaning", they are found poor in detergency and also generate foams in volume, so that they are unsuited for industrial uses. Further, since the alkali metal salt of aspartic-N,N-diacetic acid contained in such detergents is a racemate, microbial decomposability of these detergents is only around 80%, and thus they cannot be perfectly decomposed in activated sludge treatment of waste water.

Many studies have been made for the development of the compounds having satisfactory microbial decomposability and usable as detergent component, but there has yet been developed no compound which can satisfy both requirements for cleaning performance and microbial decomposability.

In view of the above, the present inventors have pursued extensive researches on the subject matter and, as a result, found that alkali metal salts of L-aspartic N,N-diacetic acid have excellent microbial decomposability, show a strong chelating power in the presence of an alkali metal hydroxide under strongly alkali conditions and, in use as a detergent component, can satisfy both requirements for cleaning performance and microbial decomposability. It was further found that the potency of this compound is even more enhanced when blended with a copolymer containing acrylic acid and maleic acid and/or an alkali metal salt of hexametaphosphoric acid as scale formation preventing agent (hereinafter referred to as scale inhibitor). The present invention has been attained on the basis of the above finding.

SUMMARY OF THE INVENTION

The present invention has for its object to provide a detergent composition, particularly one effective for cleaning hard surfaces, which is cleared of the prior art problems such as mentioned above and has high detergency and microbial decomposability. This detergent is capable of removing dirt, grime, smears, stains and other contaminants, particularly those on hard surfaces of containers for foodstuffs such as drinks and processed foods, container boxes, piping of foods production apparatus, tanks, sterilizing plates, filling machines and such.

The detergent composition according to an embodiment of the present invention comprises an alkali metal hydroxide and an alkali metal salt of L-aspartic-N,N-diacetic acid.

In another embodiment of the present invention, it provides a detergent composition comprising an alkali metal hydroxide, an alkali metal salt of L-aspartic-N,N-diacetic acid and a scale inhibitor. This detergent is particularly effective for hard surface cleaning, specifically for industrial stationary cleaning.

In still another embodiment of the present invention, it provides a detergent composition comprising an alkali metal hydroxide, an alkali metal salt of L-aspartic-N,N-diacetic acid, an alkali metal salt of gluconic acid and optionally a scale inhibitor. This detergent is useful for hard surface cleaning, particularly cleaning of glass containers.

DESCRIPTION OF PREFERRED EMBODIMENTS

Alkali metal hydroxides usable in the present invention include sodium hydroxide and potassium hydroxide, the former being preferably used.

Alkali metal salts of L-aspartic-N,N-diacetic acid usable in this invention are the derivatives o f L-aspartic acid, which can be easily synthesized from L-aspartic acid, hydrocyanic acid, formaldehyde and an alkali metal hydroxide. For instance, they can be easily synthesized by the process disclosed in JP-A-7–88913. Alkali metal salts recommended for use in this invention are sodium salt and potassium salt, the former being preferred.

The detergent composition of the present invention comprising an alkali metal hydroxide and an alkali metal salt of L-aspartic-N,N-diacetic acid mentioned above is capable of removing various types of contaminants or, owing to excellent calcium ion take-up ability of L-aspartic-N,N-diacetic acid, dissolving away insoluble calcium salts such as calcium oxalate attached to various types of food containers, container boxes, piping of production plants of drinks and processed foods such as beer, processed dairy products, etc., inter walls of tanks, sterilizing plates, filling machines and such.

If an acidic material exists in large quantities in the apparatus to be cleaned, the alkali metal hydroxide in the detergent composition is consumed through neutralization with this acidic material, so that in such a case a scale inhibitor is added to the detergent composition to elevate its detergency. In the case of beer producing apparatus, for instance, carbon dioxide remains in volume in the apparatus after the product has been withdrawn. Under such a condition, the alkali metal hydroxide in the detergent composition is reacted with the residous carbon dioxide in the apparatus to produce an alkali carbonate. This alkali carbonate is reacted with calcium ions to form water-insoluble calcium carbonate, which separates out in the detergent solution or is deposited on the cleaned equipment wall surface. This calcium carbonate is also causative of clogging of piping, spray nozzles and such.

Scale inhibitor serves for dispersing said water-insoluble calcium salt to prevent it from separating out or being deposited on the hard surfaces to allow stationary cleaning. As such scale inhibitor, there can be used, for instance, copolymers containing acrylic acid or its alkali metal salts and maleic acid or its alkali metal salts as monomeric components and having a weight average molecular weight of 3,000 or greater, preferably 3,000 to 70,000; hexametaphosphoric acid and/or its alkali metal salts, and the like, either singly or in combination. These scale inhibitors do not impair the detergency of the composition of the present invention.

The detergent composition of the present invention may contain an alkali metal salt of gluconic acid as the third component in addition to said two components, viz. an alkali metal hydroxide and an alkali metal salt of L-aspartic-N,N-diacetic acid. This third component has the effect of affording gloss to glass, therefore the detergent composition containing it can be advantageously used for cleaning glass containers. This three-component detergent composition may further contain the above scale inhibitor.

The amounts of the components of the above two-component detergent composition according to the present invention are decided so that when the composition is diluted with water to form an aqueous solution, the alkali metal hydroxide will exist in a ratio of 0.5–4 wt %, preferably 1–3 wt %, while the alkali metal salt of L-aspartic-N,N-diacetic acid will exist in a ratio of 0.1–2 wt %, preferably 0.1–1 wt %.

The amounts of the components of the above three-component detergent composition according to the present invention are decided so that when the composition is diluted with water to form an aqueous solution, the alkali metal hydroxide will exist in a ratio of 0.5–4 wt %, preferably 1–3 wt %, the alkali metal salt of L-aspartic-N,N-diacetic acid will exist in a ratio of 0.1–2 wt %, preferably 0.1–1 wt %, and the alkali metal salt of gluconic acid will exist in a ratio of 0.1–0.4 wt %.

In case a scale inhibitor is contained in the composition, its amount to be blended is so selected that when the composition is diluted with water to form an aqueous solution, said inhibitor will exist in a concentration of 10–500 ppm, preferably 10–100 ppm in the case of acrylic acid/maleic acid copolymers and alkali metal salts thereof, and 200–500 ppm, preferably 300–500 ppm in the case of hexametaphosphoric acid and/or its alkali metal salt.

The alkali metal salt of L-aspartic-N,N-diacetic acid contained in the detergent composition of the present invention is perfectly decomposed (decomposition rate: 100%) by the microorganisms in activated sludge treatment, making it possible to accomplish biochemical treatment of waste water containing the detergent composition. In contrast, the conventional alkali metal salts of ethylenediamine-tetraacetic acid are not decomposed at all (decomposition rate: 0%) by the microorganisms. Also, decomposition of the conventional alkali metal salts of racemic aspartic-N,N-diacetic acid by the microorganisms is incomplete (decomposition rate: 50%). Therefore, activated sludge treatment of waste water containing these conventional metal salts was impossible or incomplete. The detergent composition of the present invention contains a substance with excellent microbial decomposability, namely an alkali metal salt of L-aspartic-N,N-diacetic acid as an essential component, so that its use as an industrial detergent is suited.

The detergent composition of the present invention may be prepared into a high-concentration liquid or powdery detergent by mixing the above respective components in the prescribed proportions, and the preparation may be diluted with water to a prescribed concentration for use. Also, the components may be mixed while diluting with water in the prescribed proportions.

If necessary, additives for adjusting wettability and penetrability of the composition such as surfactant and organic solvent may be added to the detergent composition of the present invention.

The present invention is further illustrated by the following examples, but it should be understood that these examples are merely intended to be illustrative and not to be construed as limiting the scope of the invention in any way.

The following abbreviations of the compounds are used in the Examples:

ASDA: L-aspartic-N,N-diacetic acid
ASDA-4Na: tetrasodium salt of L-aspartic-N,N-diacetic acid
EDTA: ethylenediaminetetraacetic acid
EDTA-4Na: tetrasodium salt of ethylenediaminetetraacetic acid
NTA: nitrilotriacetic acid
NTA-3Na: trisodium salt of nitrilotriacetic acid
GNA: sodium gluconate
STPP: sodium tripolyphosphate
AA/MA: copolymer of acrylic acid and maleic acid
AA/AA: polymer of acrylic acid
OF/AA: copolymer of olefin and maleic acid
HMP: sodium hexametaphosphate
LAS-Na: anionic surfactant
NPE(7EO): nonionic surfactant

EXAMPLE 1

The aqueous detergent solutions of the compositions shown in Table 1 and Table 2 were prepared and their calcium ion take-up ability was measured. Table 1 shows a comparison of calcium ion uptake by EDTA and ASDA with different NaOH contents of the detergent solution. In Table 2, calcium ion uptake by EDTA and ASDA is compared under the condition of 3% NaOH content of the detergent solution, in the presence of 100 ppm of AA/MA or 100 ppm of HMP or without additive. Calcium ion uptake was indicated in mg of calcium carbonate per one gram of the compound used in the detergent. Evaluation was made according to photometric titration method using an automatic titration apparatus. A 1% sodium laureate solution was used as indicator, and a 0.01M sodium acetate solution was used as titrant.

TABLE 1

| Chelating agent | Aqueous solution of detergent composition NaOH (%) | | | |
|---|---|---|---|---|
| | 0.5 | 1.0 | 2.0 | 3.0 |
| EDTA | 240 | 248 | 238 | 229 |
| ASDA | 269 | 266 | 236 | 204 |
| NTA | — | — | — | 181 |
| STPP | — | — | — | 18 |
| GNA | — | — | — | 8 |

TABLE 2

| Chelating agent | Aqueous solution of detergent. composition Additive | | |
|---|---|---|---|
| | No additive | AA/MA 100 ppm | HMP 100 ppm |
| EDTA | 229 | 256 | 245 |
| ASDA | 200 | 203 | 198 |

The results of Table 1 and Table 2 show that ASDA can take up calcium ions sufficiently when the NaOH content of the detergent is in the range of 0.5–3%, which is the level generally employed in stationary cleaning, and that its calcium ion take-up ability will not be affected by the presence of 100 ppm of AA/MA or HMP used as additive.

EXAMPLE 2

The aqueous detergent solutions of the composition shown in Table 3 were prepared, and its ability to dissolve calcium oxalate, which is a typical example of water-insoluble grime often seen on the walls of storage tanks in beer breweries, was evaluated.

For making evaluation, 100 mg of calcium oxalate was added to 50 ml of each sample of detergent solution, and after stirring at 20° C. for 10 minutes, the detergent solution was passed through a filter. The portion of calcium oxalate left undissolved on the filter paper was dissolved in dilute hydrochloric acid and the amount of calcium ions existing in this acidic solution was determined by chelate titration and converted to the amount of calcium oxalate, from which the dissolution rate of calcium oxalate was calculated.

Dissolution rate of calcium oxalate in Table 3 shows percent by weight (wt %) of the dissolved portion of calcium oxalate based on the initially added amount of calcium oxalate (grime).

TABLE 3

| Detergent composition | | Rate of dissolution of calcium oxalate (%) |
|---|---|---|
| Type and amount (%) of alkali | Type and amount (%) of chelating agent | |
| NaOH 3 | — | 5 |
| NaOH 3 | ASDA 0.4 | 65 |
| NaOH 3 | EDTA 0.4 | 65 |
| NaOH 3 | NTA 0.4 | 62 |
| NaOH 3 | GNA 0.4 | 10 |
| NaOH 3 | STPP 0.4 | 18 |

The results of Table 3 clearly show that ASDA to be used for the detergent composition of the present invention in an aqueous 3% NaOH solution has a dissolution ability for calcium oxalate, that is well comparative with that of EDTA used for conventional detergent compositions.

EXAMPLE 3

Detergent solution sample Nos. 1–4 of the compositions shown in Table 4 were prepared and formation of scale in these samples was observed to evaluate the scale inhibitory effect of these samples. Evaluation was made in the manner described below.

First, 100 mg of calcium oxalate was added to 50 ml of each sample solution and after stirring at 20° C. for 10 minutes, the solution was passed through a filter. The filtrate with calcium ions dissolved therein was collected in a sample bottle and allowed to stand overnight at room temperature, and then the state of the filtrate and formation of scale at the bottom of the bottle were observed. The results are shown in Table 4.

Then, on the assumption that one operation of circulation cleaning of a tank of a beer factory by use of a detergent solution containing 3% of sodium hydroxide would reduce the sodium hydroxide content to 1% and generate 2.7% of sodium carbonate, there were prepared the detergent solution sample Nos. 5–8 containing 1% of sodium hydroxide and 2.7% of sodium carbonate. These sample Nos. 5–8 were evaluated in the same manner as described above and rated according to the following three-grade (A–C) criterion:

A: Filtrate was clear.
B: Filtrate was cloudy.
C: Scale was deposited at the bottom of the bottle.

The results are shown in Table 4.

TABLE 4

| Sample No. | Components of detergent composition | | | |
|---|---|---|---|---|
| | NaOH (%) | $Na_2CO_3$ (%) | ASDA (%) | State of sample |
| 1 | 3 | — | 0.1 | A |
| 2 | 3 | — | 0.4 | A |
| 3 | 3 | — | 1.0 | A |
| 4 | 3 | — | 2.0 | A |
| 5 | 1 | 2.7 | 0.1 | C |
| 6 | 1 | 2.7 | 0.4 | B |
| 7 | 1 | 2.7 | 1.0 | A |
| 8 | 1 | 2.7 | 2.0 | A |

In Table 4, sample Nos. 1–4 (compositions of the present invention) are of a state where sodium hydroxide exists in large quantities in the filtrate. As seen in Table 4, the sample of this state is ranked A, and if the content of ASDA is within the range of 0.1–2.0% detergent composition has the ability to keep calcium ions dissolved in the solution.

On the other hand, when sodium carbonate is generated in large quantities in the filtrate to reduce the available alkali content (amount of sodium hydroxide) in the case of sample Nos. 5–8, the disolved calcium ions are released from ASDA and separate out into the solution in the form of calcium carbonate correspondingly to the decrease of ASDA content as seen from Table 4, and this causes clouding of the filtrate solution, sedimentation of calcium carbonate and deposition of scale at the bottom of the bottle.

EXAMPLE 4

Sample No. 5 of Example 3, namely a detergent solution containing 1% of sodium hydroxide, 2.7% of sodium carbonate and 0.1% of ASDA (ranked C in above evaluation) was blended with additives shown in Table 5 to prepare samples 9–24, and these samples were evaluated in the same way as in Example 3. The results are shown in Table 5.

TABLE 5

| Sample No. | Components | | | | |
|---|---|---|---|---|---|
| | Aqueous solution of detergent composition | Additive | Molecular weight | Content (ppm) | State of solution |
| 9 | Sample No. 5 in Table 4 | AA/MA | 3000 | 100 | A |
| 10 | Sample No. 5 in Table 4 | AA/MA | 50000 | 100 | A |
| 11 | Sample No. 5 in Table 4 | AA/MA | 70000 | 100 | A |
| 12 | Sample No. 5 in Table 4 | HMP | — | 500 | A |
| 13 | Sample No. 5 in Table 4 | AA/AA | 4500 | 500 | C |
| 14 | Sample No. 5 in Table 4 | AA/AA | 20000 | 500 | C |
| 15 | Sample No. 5 in Table 4 | OF/MA | 6000 | 500 | B |
| 26 | Sample No. 5 in Table 4 | EDTA-4Na | — | 500 | B |
| 17 | Sample No. 5 in Table 4 | NTA-3Na | — | 500 | B |
| 18 | Sample No. 5 in Table 4 | GNA | — | 500 | C |

TABLE 5-continued

| Sample No. | Components | | | | |
|---|---|---|---|---|---|
| | Aqueous solution of detergent composition | Additive | Molecular weight | Content (ppm) | State of solution |
| 19 | Sample No. 5 in Table 4 | STPP | — | 500 | B |
| 20 | Sample No. 5 in Table 4 | Sodium tertiary phosphate | — | 500 | B |
| 21 | Sample No. 5 in Table 4 | Sodium phosponate | — | 500 | B |
| 22 | Sample No. 5 in Table 4 | LAS-Na | — | 500 | C |
| 23 | Sample No. 5 in Table 4 | NPE (7EO) | — | 500 | C |
| 24 | Sample No. 5 in Table 4 | Betain ampholytic surfactant | — | 500 | C |

As is seen from Table 5, when the detergent composition containing 1% of sodium hydroxide, 2.7% of sodium carbonate and 0.1% of ASDA (ranked C in evaluation was blended with 100 ppm of an acrylic acid-maleic acid polymer (AA/MA) having a weight average molecular weight of 3,000 or greater (sample Nos. 9–11) or with 500 ppm of sodium salt of hexametaphosphoric acid (sample No. 12), the evaluation rank was elevated from C to A. This indicates that addition of a scale inhibitor to the composition of the present invention provides further boost of the cleaning effect, especially in stationary cleaning.

EXAMPLE 5

Using sample No. 5 in Table 4, namely an aqueous detergent solution containing 1% of sodium hydroxide, 2.7% of sodium carbonate and 0.1% of ASDA, the same evaluation test as in Example 3 was conducted to examine the relation between the amount of scale inhibitor added and its cleaning effect. The results are shown in Table 6.

TABLE 6

| Sample No. | Components | | | | |
|---|---|---|---|---|---|
| | Aqueous solution of detergent composition | Additive | Molecular weight | Content (ppm) | State of solution |
| 25 | Sample No. 5 in Table 4 | AA/MA | 70000 | 10 | A |
| 26 | Sample No. 5 in Table 4 | " | " | 50 | A |
| 27 | Sample No. 5 in Table 4 | " | " | 100 | A |
| 28 | Sample No. 5 in Table 4 | " | " | 300 | A |
| 29 | Sample No. 5 in Table 4 | " | " | 500 | A |
| 30 | Sample No. 5 in Table 4 | HMP | — | 10 | C |
| 31 | Sample No. 5 in Table 4 | " | — | 100 | C |
| 32 | Sample No. 5 in Table 4 | " | — | 200 | A |
| 33 | Sample No. 5 in Table 4 | " | — | 300 | A |
| 34 | Sample No. 5 in Table 4 | " | — | 500 | A |

It is seen from Table 6 that when a scale inhibitor is blended in an amount within the range of 10–500 ppm in case of using AA/MA and within the range of 200–500 ppm in case of using HMP, there is produced a noticeable scale formation suppressive effect to improve the detergency of the composition.

EXAMPLE 6

Using the two-component detergent solutions containing sodium hydroxide and ASDA and the four-component detergent solutions containing sodium hydroxide, sodium carbonate, ASDA and scale inhibitor in the rates shown in Table 7, dissolubility of calcium oxalate with relation to the change of ASDA content was measured while observing the state of the solution. The results are shown in Table 7. The state of the solution was evaluated according to the same three-grade ranking criterion as used in Example 3. In Example 6, EDTA was used in place of ASDA.

TABLE 7

| | Components | | | | | |
|---|---|---|---|---|---|---|
| Sample No. | NaOH (%) | $Na_2CO_3$ (%) | Chelating agent (%) | Scale inhibitor (ppm) | Rate of dissolution of calcium oxalate (%) | State of solution |
| 35 | 3 | — | ASDA (0.1) | — | 22 | A |
| 36 | 3 | — | ASDA (0.2) | — | 38 | A |
| 37 | 3 | — | ASDA (0.3) | — | 50 | A |
| 38 | 3 | — | ASDA (0.4) | — | 64 | A |
| 39 | 3 | — | EDTA (0.1) | — | 18 | A |
| 40 | 3 | — | EDTA (0.2) | — | 37 | A |
| 41 | 3 | — | EDTA (0.3) | — | 49 | A |
| 42 | 3 | — | EDTA (0.4) | — | 65 | A |
| 43 | 1 | 2.7 | ASDA (0.1) | AA/MA (100) | 18 | A |
| 44 | 1 | 2.7 | ASDA (0.2) | AA/MA (100) | 30 | A |
| 45 | 1 | 2.7 | ASDA (0.3) | AA/MA (100) | 47 | A |
| 46 | 1 | 2.7 | ASDA (0.4) | AA/MA (100) | 64 | A |
| 47 | 1 | 2.7 | ASDA (0.1) | HMP (200) | 18 | A |
| 48 | 1 | 2.7 | ASDA (0.2) | HMP (200) | 31 | A |
| 49 | 1 | 2.7 | EDTA (0.1) | — | 18 | A |
| 50 | 1 | 2.7 | EDTA (0.2) | — | 35 | A |
| 51 | 1 | 2.7 | EDTA (0.3) | — | 51 | A |
| 52 | 1 | 2.7 | EDTA (0.4) | — | 66 | A |

As is seen from Table 7, the detergent composition of the present invention has both effect of dissolving away grime and effect of preventing formation of scale, well comparable with those of the conventional detergents using EDTA.

EXAMPLE 7

The ability of the detergent composition of the present invention to dissolve away grime in coffer production line was evaluated. For making evaluation, an artificially grimed plate was prepared by immersing a stainless steel plate in a coffer solution and heating it for a long time to cause deposition of grime on the stainless surface, followed by aging.

This artificially grimed plate was subjected to circulation cleaning and rinsing with the aqueous solutions of detergent compositions shown in Table 8 under the conditions of 80° C. and flow rate of 0.85 $m^3$/hr for 30 minutes, and then reflectance of the cleaned surface of the plate was measured as an index of detergency. The results are shown in Table 8.

TABLE 8

| Detargent composition | | Cleaning effect (reflectance) |
|---|---|---|
| 2% NaOH-chelating agent | 0% | 51% |
| 2% NaOH-ASDA | 0.4% | 61% |
| 2% NaOH-EDTA | 0.4% | 59% |
| 2% NaOH-NTA | 0.4% | 59% |
| 2% NaOH-GNA | 0.4% | 52% |
| 2% NaOH-STPP | 0.4% | 52% |

Table 8 testifies that the detergent composition of the present invention, when used for stationary cleaning of coffee production apparatus, shows as high cleaning performance as the conventional detergent compositions containing EDTA and NTA which are considered to have particularly high detergency among the known detergents.

EXAMPLE 8

An artificially grimed plate was prepared by applying a 10% water suspension of diatomaceous earth uniformly on a glass plate and then drying it by heating at 105° C. for 8 hours. Using this artificially grimed plate, the cleaning effect of the aqueous detergent solutions of the compositions shown in Table 9 (sample Nos. 1–6) was evaluated. Also, beer bottles were cleaned with the aqueous detergent solutions of Table 9 and the produced effect (glossing) on the bottle surface was visually evaluated.

For determining the cleaning effect, the artificially grimed plate was immersed in each of the aqueous detergent solutions heated to 80° C. for 10 minutes, then rinsed with hot water and dried well, and the amount of grime left on the plate surface was measured by a glossmeter. Cleaning efficiency was calculated from this measurement and the measured value of glossiness of the artificially grimed plate before cleaning. The results are shown in Table 9. The aqueous detergent solutions of Table 9 were prepared by using two types of hard water having a calcium carbonate concentration of 60 ppm and 200 ppm, respectively.

TABLE 9

| Sample No. | Components NaOH (%) | ASDA (%) | GNA (%) | EDTA (%) | Cleaning efficiency (%) 60 ppm | 200 ppm | Result on beer bottles 60 ppm | 200 ppm |
|---|---|---|---|---|---|---|---|---|
| 1 | 4 | — | 0.2 | — | 69 | 39 | No gloss | No gloss |
| 2 | 4 | — | 0.4 | — | 74 | 48 | Glossy | Glossy |
| 3 | 4 | 0.1 | 0.2 | — | 95 | 88 | Glossy | Glossy |
| 4 | 4 | 0.1 | 0.4 | — | 96 | 89 | Glossy | No gloss |
| 5 | 4 | 0.2 | — | — | 92 | 86 | No gloss | No gloss |
| 6 | 4 | 0.2 | 0.1 | — | 94 | 90 | Glossy | Glossy |
| 7 | 4 | 0.2 | 0.2 | — | 96 | 93 | Glossy | Glossy |
| 8 | 4 | 0.5 | 0.1 | — | 97 | 97 | Glossy | Glossy |
| 9 | 4 | 1.0 | 0.1 | — | 97 | 96 | Glossy | Glossy |
| 10 | 4 | 1.0 | 0.2 | — | 97 | 96 | Glossy | Glossy |
| 11 | 4 | 2.0 | 0.1 | — | 96 | 96 | Glossy | Glossy |
| 12 | 4 | — | — | 0.2 | 98 | 95 | No gloss | No gloss |
| 13 | 4 | — | 0.2 | 0.2 | 98 | 94 | No gloss | No gloss |

It is seen from Table 9 that use of ASDA is effective for removing grime of inorganic matter deposited on glass surface. Its effect was high in the detergent solutions using either of the above two types of hard water. On the other hand, single use of sodium gluconate was not so effective and the detergent using this compound sharply lowered in detergency as hardness of water increased.

In contrast, when the glass bottles were cleaned by using a detergent solution containing both of ASDA and sodium gluconate, gloss was provided on the cleaned glass bottle surfaces, indicating excellent finishing effect of this combination.

EXAMPLE 9

Microbial decomposability of the ASDA-containing detergent composition of the present invention was determined according to the Modified SCAS Test shown in the OECD Guideline for Testing of Chemicals.

In the test, the test tank was aerated by an air pump every day through the test period, and a test sample solution was sampled out at intervals of several days to check the residue (percentage of the remaining portion) of the compound by HPLC and TOC (total organic carbon), from which the rate of decomposition by the microorganism was determined. The results are shown in Table 10.

TABLE 10

| | HPLC decomposition degree | TOC | Degree of decomposition |
|---|---|---|---|
| L-ASDA | 100 | 0 | 100 |
| EDTA | 0 | 100 | 0 |
| Racemic ASDA | 50 | 50 | 50 |

This application is based on Japanese Patent Application No. 7–350042 filed in Japan on Dec. 25, 1995, the content of which is incorporated herein by reference.

What is claimed is:

1. A detergent composition for circulation, spray or stationary cleaning of production equipment or containers, consisting essentially of an alkaline metal hydroxide and an alkaline metal salt of L-aspartic-N,N-diacetic acid.

2. A detergent composition for hard surface cleaning comprising an alkali metal hydroxide, an alkali metal salt of L-aspartic-N,N-diacetic acid and a scale inhibitor.

3. A detergent composition according to claim 2, wherein the scale inhibitor is a copolymer containing acrylic acid or its alkali metal salt and maleic acid or its alkali metal salt as monomeric components.

4. A detergent composition according to claim 3, wherein the molecular weight of said copolymer is at least 3,000.

5. An aqueous solution of the detergent composition set forth in claim 3, wherein said copolymer is contained in an amount of 10–500 ppm.

6. A detergent composition according to claim 2, wherein the scale inhibitor is hexametaphosphoric acid and/or its alkali metal salt.

7. An aqueous solution of the detergent composition set forth in claim 6, wherein hexametaphosphoric acid and/or its alkali metal salt is contained in an amount of 200–500 ppm.

8. A method for cleaning a hard surface of an article to be cleaned, which comprises applying a detergent composition of claim 2 to said hard surface, carrying out a cleaning-in-place of said hard surface and rinsing said hard surface.

9. A detergent composition for circulation, spray or stationary cleaning of production equipment or containers, consisting essentially of an aqueous solution of an alkaline metal hydroxide and an alkaline metal salt of L-aspartic-N, N-diacelic acid.

* * * * *

UNITED STATES PATENT AND TRADEMARK OFFICE

CERTIFICATE OF CORRECTION

PATENT NO. : 6,093,687
DATED : July 25, 2000
INVENTOR(S) : Saito et al.

It is certified that error appears in the above-identified patent and that said Letters Patent is hereby corrected as shown below:

Title page,
Please change "[73] Assignee: Nitto Chemical Industries Co., Ltd., Tokyo, Japan"
to
-- [73] Assignee: Mitsubishi Rayon Co., Ltd., Tokyo, Japan --

Signed and Sealed this

Twenty-eighth Day of May, 2002

*Attest:*

*Attesting Officer*

JAMES E. ROGAN
*Director of the United States Patent and Trademark Office*